US008960367B1

(12) United States Patent
Leclerc

(10) Patent No.: US 8,960,367 B1
(45) Date of Patent: Feb. 24, 2015

(54) ACOUSTIC PANEL

(71) Applicant: Jean Leclerc, Rosemere (CA)

(72) Inventor: Jean Leclerc, Rosemere (CA)

( * ) Notice: Subject to any disclaimer, the term of this patent is extended or adjusted under 35 U.S.C. 154(b) by 0 days.

(21) Appl. No.: 14/075,425

(22) Filed: Nov. 8, 2013

(51) Int. Cl.
*E04B 1/99* (2006.01)
*G10K 11/00* (2006.01)

(52) U.S. Cl.
CPC ..... *G10K 11/002* (2013.01)
USPC ..... 181/286; 181/30

(58) Field of Classification Search
CPC ..... E04B 1/84; E04B 1/8414; E04B 1/8419; E04B 1/8428; E04B 1/8452; E04B 1/8263; G10K 11/20
USPC ..... 181/30, 284, 286, 290, 293, 295
See application file for complete search history.

(56) References Cited

U.S. PATENT DOCUMENTS 2,935,152 A * 5/1960 Maccaferri ..... 181/290
3,068,956 A * 12/1962 Cooley ..... 181/289
4,261,433 A * 4/1981 Propst ..... 181/286
4,356,880 A * 11/1982 Downs ..... 181/30
4,393,631 A * 7/1983 Krent ..... 52/144
4,821,839 A * 4/1989 D'Antonio et al. ..... 181/198
5,160,816 A * 11/1992 Chlop ..... 181/285
5,579,614 A * 12/1996 Dorn ..... 52/144
5,764,782 A * 6/1998 Hayes ..... 381/160
6,772,859 B2 * 8/2004 D'Antonio et al. ..... 181/293
6,782,670 B2 * 8/2004 Wendt ..... 52/506.07
6,793,037 B1 * 9/2004 Babuke et al. ..... 181/293
7,308,965 B2 * 12/2007 Sapoval et al. ..... 181/210
7,428,948 B2 * 9/2008 D'Antonio et al. ..... 181/293
7,520,370 B2 * 4/2009 Gudim ..... 181/293
7,703,575 B2 * 4/2010 Berger et al. ..... 181/293
8,573,356 B1 * 11/2013 Perdue ..... 181/284
2006/0042875 A1 * 3/2006 Zainea ..... 181/293
2008/0308349 A2 * 12/2008 Magyari ..... 181/295
2012/0018247 A1 * 1/2012 Gideonse ..... 181/293
2012/0312631 A1 * 12/2012 Curfman ..... 181/286

* cited by examiner

*Primary Examiner* — Jeremy Luks

(57) ABSTRACT

An acoustic panel for diffusing sound waves, the acoustic panel comprising: a panel front surface and a substantially opposed panel back surface; the panel front surface defining a plurality of front surface regions each delimited by a respective front surface region perimeter, each of the front surface regions being curved. The sound waves incoming at the panel front surface are diffused by the panel front surface.

14 Claims, 3 Drawing Sheets

ACOUSTIC PANEL

FIELD OF THE INVENTION

The present invention relates to the general field of acoustics and is particularly concerned with an acoustic panel usable for modifying the acoustic properties of an enclosed space.

BACKGROUND

Audiophiles wish to listen to music in a form that most closely resemble an ideal sound reproduction. The music may be produced for immediate listening or be recorded and listened to later. For example, the ideal sound reproduction reproduces the recorded sounds as they would be heard in an infinite room. Unfortunately, enclosing any sound source in a room creates parasitic echos as the sound is reflected by the walls of the room and other objects found therein.

There are two main types of devices used to reduce these echos. These devices are disposed at selected locations in the room, for example on the walls. The first type aims at absorbing part of the sounds waves. To that effect, it either includes a sound absorbing substance, or has a surface that defines a plurality of small recesses in which the sound is reflected multiple times to gradually lose intensity. A disadvantage of absorption type devices is that they typically don't have a uniform absorption across the whole range of sound frequencies. This creates therefore a preferential absorption a some frequencies, typically the higher frequencies, which distorts the spectral characteristics of the sound that remains after absorption, which can be heard and produces what is called a "dead" room.

In the other type of devices, the sound waves are diffused in the room, which distributes the residual sound energy across the whole room. A disadvantage of these types of devices is that they usually need to be relatively large to be effective. A further disadvantage of these devices is that they are typically effective only at a distance of many feet from the device. Therefore, a listener positioned, for example, within one foot of the device will not benefit from the whole echo cancellation capabilities of the device. In smaller rooms, this is problematic as it is almost impossible to provide good echo cancellation as there is no location in the room where the devices are fully effective.

Accordingly, there exists a need for an improved device for modifying the acoustic properties of a room. It is a general objective of the present invention to provide such an improved device.

SUMMARY OF THE INVENTION

In a broad aspect, the invention provides an acoustic panel for diffusing sound waves, the acoustic panel comprising: a panel front surface and a substantially opposed panel back surface; the panel front surface defining a plurality of front surface regions each delimited by a respective front surface region perimeter, each of the front surface regions being curved. The sound waves incoming at the panel front surface are diffused by the panel front surface.

In a some embodiments of the invention, the front surface regions are discontinuous from each other such that a transition between two adjacent ones of the front surface regions defines a discontinuity in the panel front surface. For example, all of the front surface regions are convex.

In a some embodiments of the invention, the front surface regions each define a curved direction and a flat direction substantially perpendicular thereto, the front surface regions being curved along the curved direction and rectilinear along the flat direction. Typically, the front surface regions are disposed in a grid and cover all of the panel front surface, adjacent ones of the front surface regions that have partially parallel and adjacent front surface region perimeters having differently oriented curved directions.

In a some embodiments of the invention, each of the front surface regions defines a zenith along the curved direction. In a some embodiments of the invention, each of the front surface regions defines a geometric center, the zenith being offset from the geometric center along the curved direction.

In a some embodiments of the invention, a projection of each of the front surface regions on the panel back surface is substantially rectangular. In a some embodiments of the invention, a projection of each of the front surface regions on the panel back surface is substantially square.

In a some embodiments of the invention, the front surface regions defines at least one group including first, second, third and fourth front surface regions selected from all of the front surface regions, the first, second, third and fourth front surface regions being such that the first and second front surface regions are adjacent to each other and have partially parallel and adjacent front surface region perimeters; the third and fourth front surface regions are adjacent to each other and have partially parallel and adjacent front surface region perimeters; the first and third front surface regions are adjacent to each other and have partially parallel and adjacent front surface region perimeters; the second and fourth front surface regions are adjacent to each other and have partially parallel and adjacent front surface region perimeters; the curved directions of the first and fourth front surface regions are substantially parallel to each other; the curved directions of the second and third front surface regions are substantially parallel to each other; and the curved directions of the first and second front surface regions are substantially perpendicular to each other.

In a some embodiments of the invention, the first, second, third and fourth front surface regions are such that the geometric center of the first front surface region is provided between the zenith of the first front surface region and the second front surface region; the geometric center of the second front surface region is provided between the zenith of the second front surface region and the fourth front surface region; the geometric center of the third front surface region is provided between the zenith of the third front surface region and the first front surface region; and the geometric center of the fourth front surface region is provided between the zenith of the fourth front surface region and the third front surface region.

In a some embodiments of the invention, the back surface is substantially flat, each of the front surface regions defining a zenith-to back surface distance, the zenith-to-back surface distances being selected from a discrete number of distances smaller than a number of the front surface regions. For example, the discrete number is 2.

In a some embodiments of the invention, the front surface regions have a substantially arc segment-shaped configuration along the curved direction.

In a some embodiments of the invention, the acoustic panel is solid between the panel front and back surfaces.

In a some embodiments of the invention, the front surface regions are substantially adjacent to each other.

In a some embodiments of the invention, the acoustic panel includes a plurality of acoustic elements, each of the acoustic element defining a respective one of the front surface regions, the acoustic elements being in a side-by-side relationship relative to each other.

In a some embodiments of the invention, the acoustic elements abut against each other.

In a some embodiments of the invention, the panel front surface is a wood surface.

In a some embodiments of the invention, the panel front surface is configured to prevent multiple reflections on the acoustic panel of the sound waves incoming on substantially all of the panel front surface.

Other objects, advantages and features of the present invention will become more apparent upon reading of the following non-restrictive description of preferred embodiments thereof, given by way of example only with reference to the accompanying drawings.

DETAILED DESCRIPTION

Figure 1:
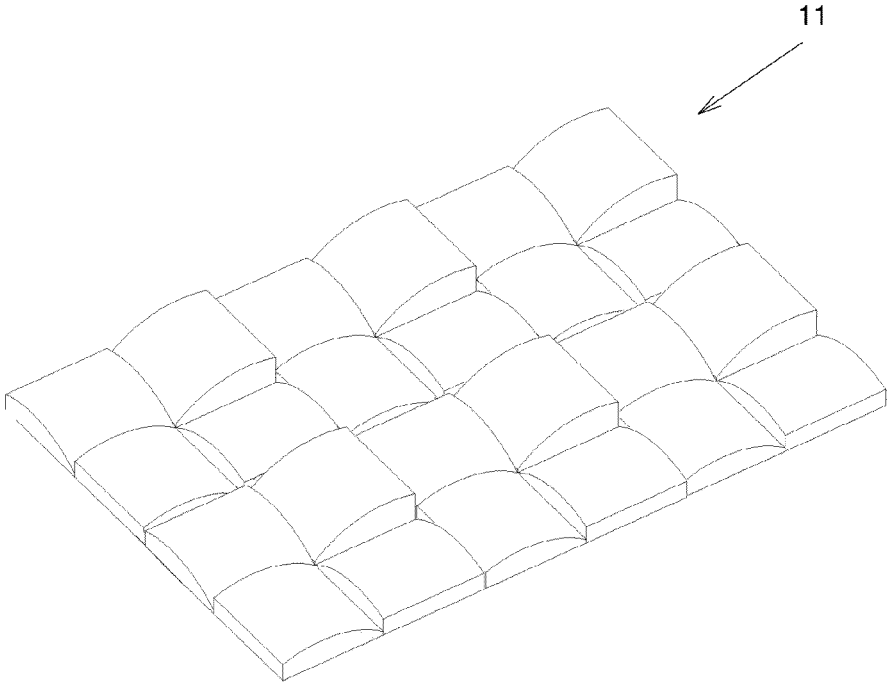
FIG. 1, in a perspective view, illustrates an acoustic panel in accordance with an embodiment of the present invention.

Referring to FIG. 1, there is shown an acoustic panel 11 for diffusing sound waves. While FIG. 1 illustrates a typical acoustic panel 11, the remainder of the description will mainly concentrate on the acoustic panel 10 shown in FIG. 2, which shows a smaller acoustic panel 10 so that reference numerals can be added clearly. The acoustic panel 10 includes a panel front surface 12 and a substantially opposed panel back surface 14. The panel front surface 12 defines a plurality of front surface regions 16A, 16B, 16C and 16D each delimited by a respective front surface region perimeter 18A, 18B, 18C and 18D. Each of the front surface regions 16A, 16B, 16C and 16D is curved. The sound waves incoming at the panel front surface 12 are diffused by the panel front surface 12. More specifically, each of the front surface regions 16A, 16B, 16C and 16D is diffusing a portion of the sound waves incoming at the panel front surface 12. Each front surface region 16A, 16B, 16C and 16D diffuses the sound waves differently to enhance the diffusion. The curved, or in other words non-planar, configuration of the front surface regions 16A, 16B, 16C and 16D reflect different portions of a sound wave incoming at the front surface regions 16A, 16B, 16C and 16D in different directions. The thus reflected sound waves therefore spread over the whole room the information content contained in the incoming sound waves, which produces for effect that a listener's brain simply filters these sound waves so that they do not impede proper listening of the source sound waves that come directly to the listener's ears. The diffusion in many directions of the incoming sound waves is to be contrasted to the less efficient diffusion by planar surfaces of some prior art acoustic panels which also disadvantageously partially reflect the sound waves, as opposed to spreading them in many directions as in the present invention. Also, it has been found that advantageously, the proposed acoustic panel 10, in some embodiments, is effective even at relatively small distances therefrom, for example one or two feet, or even less, Throughout this document, the terminology "front" relates to parts of the acoustic panel 10 that are normally exposed to the sound waves to diffuse. Also, the terminology "substantially" is used to denote variations in the thus qualified terms that have no significant effect on the principle of operation of the acoustic panel 10. These variations may be minor variations in design or variations due to mechanical tolerances in manufacturing and use of the acoustic panel 10. These variations are to be seen with the eye of the reader skilled in the art.

Figure 2:
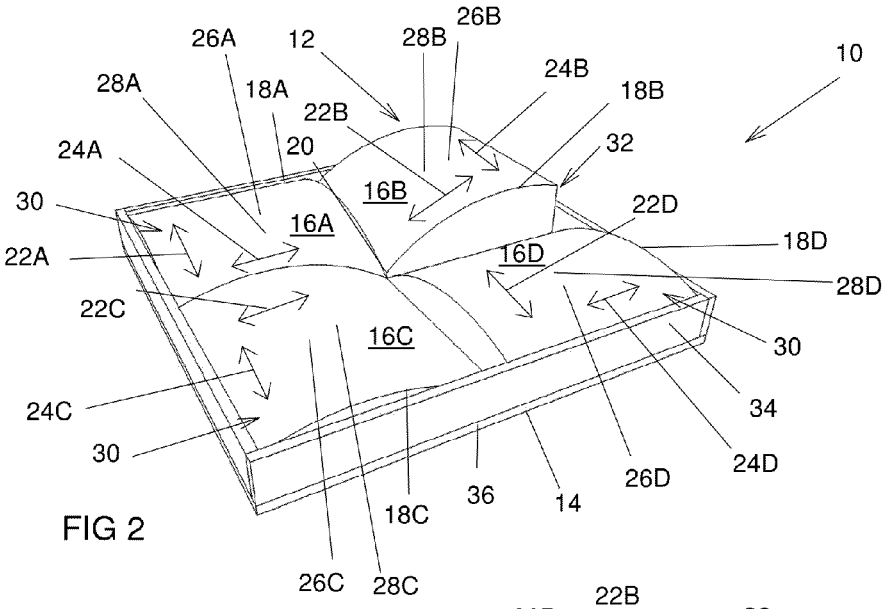
FIG. 2, in a perspective view, illustrates an acoustic panel in accordance with an alternative embodiment of the present invention.

FIG. 2 illustrates an acoustic panel 10 having only 4 front surface regions 16A, 16B, 16C and 16D. However, in alternative embodiments of the invention, the acoustic panel 10 has more than 4 front surface regions, such as for example in the acoustic panel 11 show in FIG. 1. Returning to FIG. 2, the front surface regions 16A, 16B, 16C and 16D are typically substantially adjacent to each other. However, in alternative embodiments of the invention, there may be a gap between the front surface regions 16A, 16B, 16C and 16D. Acoustic panels 10 in which there is no gap between the front surface regions 16A, 16B, 16C and 16D are typically more efficient at diffusing the sound waves.

The acoustic panel 10 is usable in a room (not shown in the drawings) to reduce parasitic echos while listening to sound, for example music. The acoustic panel 10 may be secured to the walls or ceiling of the room. In alternative embodiments, the acoustic panel 10 may be supported on a base at a suitable height and spaced apart from the walls of the room. Typically, more than one acoustic panel 10 is used in each room, but this is not necessarily the case. The locations and dimensions of the acoustic panels 10 depend on the acoustic properties of the room and the desired effect to achieve with the acoustic panels 10. A suitable configuration of acoustic panels can be determined by moving the acoustic panels 10 in a room while listening to sounds or when using sound processing equipment to determine the effect of the acoustic panels 10 on the acoustics of the room. In other embodiments, the room and the acoustic panels 10 are modeled using conventional methods to select a suitable configuration of the acoustic panels 10.

Typically, the front surface regions 16A, 16B, 16C and 16D are discontinuous from each other such that a transition between two adjacent ones of the front surface regions 16A, 16B, 16C and 16D defines a discontinuity in the panel front surface 12. The discontinuity is an abrupt transition in the "height" of the panel front surface 12 between front surface regions 16A, 16B, 16C and 16D. From the point of view of the sound waves, the sound waves have to travel different distances to arrive to two adjacent front surface regions 16A, 16B, 16C and 16D at the discontinuity therebetween It is possible to have two adjacent front surface regions 16A, 16B, 16C and 16D that are continuous along a very small portion of the front surface region perimeter 18A, 18B, 18C and 18D, such as at point 20 in FIG. 2. However, the term discontinuous means that along most of the front surface region perimeter 18A, 18B, 18C and 18D, when transitioning from one of the front surface regions 16A, 16B, 16C and 16D to another one of the front surface regions 16A, 16B, 16C and 16D, when crossing the front surface region perimeters 18A, 18B, 18C and 18D, there will be an abrupt transition in tridimensional position. It should be noted that in some embodiments of the invention, there is a gap between the front surface regions 16A, 16B, 16C and 16D. In other words, in these embodiments, there is a space between these front surface regions 16A, 16B, 16C and 16D when the panel front surface 12 is viewed facing directly towards the panel front surface 12. However, performance of the acoustic panel 10 is better when no such gap is present.

Typically, the front surface regions 16A, 16B, 16C and 16D are convex. In these embodiments, the acoustic panel 10 differs markedly from other types of sound diffusers in many aspects. First, in opposition to the conventional curve diffuser, the proposed acoustic panel redirects incoming sound in many directions. By suitably selecting the dimensions of each front surface regions 16A, 16B, 16C and 16D so that these dimensions are smaller than the wavelength at which the majority of the energy is found in the sound waves to diffuse, each sound wave is not only diffused, but it is also broken up in many sections, each section being diffused by a respective ones of the front surface regions 16A, 16B, 16C and 16D. Also, the discontinuities between adjacent front surface regions 16A, 16B, 16C and 16D create phase shifts in the sound waves that help in enhancing the sound waves diffusion.

In a specific embodiment of the invention, each front surface region defines a curved direction 22A, 22B, 22C and 22D and a flat direction 24A, 24B, 24C and 24D substantially perpendicular thereto. The front surface regions 16A, 16B, 16C and 16D are curved along the curved directions 22A, 22B, 22C and 22D and rectilinear along the flat direction 24A, 24B, 24C and 24D. In some embodiments, the front surface regions 16A, 16B, 16C and 16D have a substantially arc segment-shaped configuration along the curved directions 22A, 22B, 22C and 22D. In these embodiments, the front surface regions 16A, 16B, 16C and 16D have the shape of segments of a cylindrical shell. In some embodiments, the radius of curvature of the front surface regions 16A, 16B, 16C and 16D is similar to the linear dimensions of the front surface regions, for example within 30% thereof.

Typically, the front surface regions 16A, 16B, 16C and 16D are disposed in a grid and cover all of the panel front surface 12. Some adjacent ones of the front surface regions 16A, 16B, 16C and 16D have partially parallel and adjacent front surface region perimeters 18A, 18B, 18C and 18D. In other words, for these front surface regions 16A, 16B, 16C and 16D, a portion of the front surface region perimeters 18A, 18B, 18C and 18D are parallel and adjacent. These front surface regions 16A, 16B, 16C and 16D have differently oriented curved directions 22A, 22B, 22C and 22D. In other words, the front surface regions 16A, 16B, 16C and 16D that are "side-by-side", as opposed to oblique relative to each other, have differently oriented curved directions 22A, 22B, 22C and 22D. However, in alternative embodiments, the front surface regions 16A, 16B, 16C and 16D are disposed and oriented in any other suitable manner.

Figure 3:
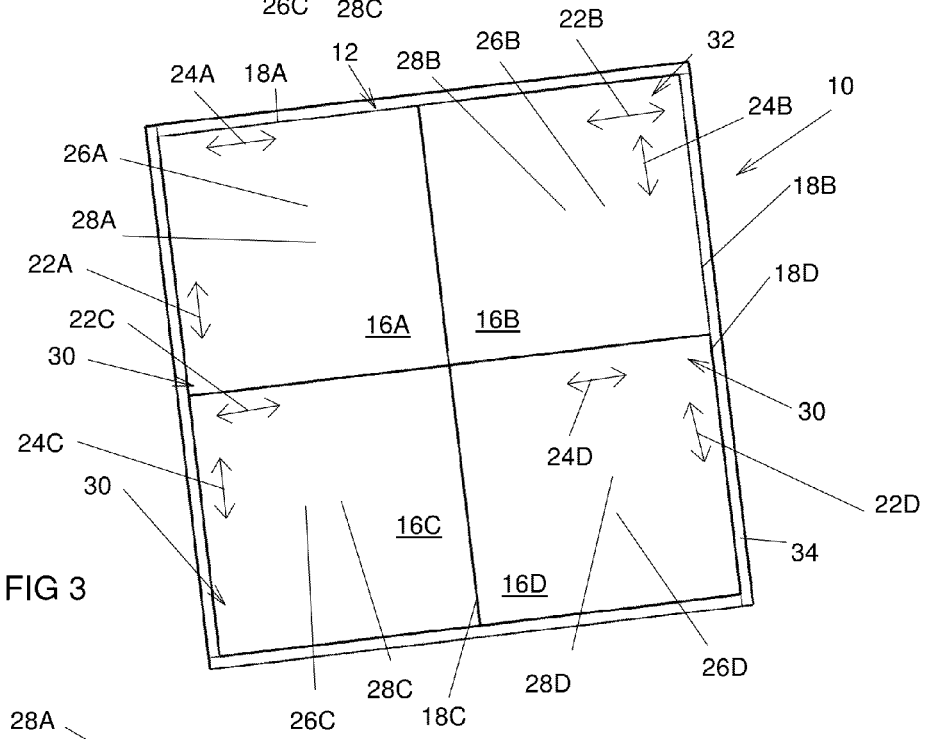
FIG. 3, in a top plan view, illustrates the acoustic panel shown in FIG. 2.

Referring to FIG. 3, in some embodiments of the invention, each of the front surface regions 16A, 16B, 16C and 16D defines a zenith 26A, 26B, 26C and 26D along the curved direction 22A, 22B, 22C and 22D. Also, each of the front surface regions 16A, 16B, 16C and 16D defines a geometric center 28A, 28B, 28C and 28D. The zenith 26A, 26B, 26C and 26D is typically offset from the geometric center 28A, 28B, 28C and 28D along the curved direction 22A, 22B, 22C and 22D, but in some embodiments of the invention, the zenith 26A, 26B, 26C and 26D is not offset from the geometric center 28A, 28B, 28C and 28D along the curved direction 22A, 22B, 22C and 22D.

In a typical embodiment of the invention, a projection of each of the front surface regions 16A, 16B, 16C and 16D on the panel back surface 14 is substantially rectangular or substantially square. However, in alternative embodiments, the front surface regions 16A, 16B, 16C and 16D have any other suitable shape.

In some embodiments of the invention, as shown in FIG. 2, the front surface regions 16A, 16B, 16C and 16D defines at least one group including first, second, third and fourth front surface regions 16A, 16C, 16B and 16D selected from all of the front surface regions 16A, 16B, 16C and 16D. In the acoustic panel 10, since there are only four front surface regions 16A, 16B, 16C and 16D, the group includes all the front surface regions 16A, 16B, 16C and 16D. However, when an acoustic panel 10 includes more than four front surface regions 16A, 16B, 16C and 16D, a group including only some of the front surface regions 16A, 16B, 16C and 16D can be formed, as in the acoustic panel 11 shown in FIG. 1. Also, in some embodiments, many groups can be provided, for example to cover the whole panel front surface 12. Each group is selected such that the first, second, third and fourth front surface regions 16A, 16C, 16B and 16D form an helicoidal pattern in an orientation of the curvature of the first, second, third and fourth front surface regions 16A, 16C, 16B and 16D, which may turn clockwise or counterclockwise. This helicoidal pattern has been found effective in diffusing and breaking up sound waves to achieve good acoustic properties for the acoustic panel 10. In addition, in alternative embodiment of the invention, the panel front surface 12 does not define this helicoidal pattern.

More specifically, the first, second, third and fourth front surface regions 16A, 16C, 16B and 16D are such that the first and second front surface regions 16A and 16C are adjacent to each other and have partially parallel and adjacent front surface region perimeters 18A and 18C;

the third and fourth front surface regions 16B and 16D are adjacent to each other and have partially parallel and adjacent front surface region perimeters 18B and 18D;

the first and third front surface regions 16A and 16B are adjacent to each other and have partially parallel and adjacent front surface region perimeters 18A and 18B;

the second and fourth front surface regions 16C and 16D are adjacent to each other and have partially parallel and adjacent front surface region perimeters 18C and 18D;

the curved directions 22A and 22D of the first and fourth front surface regions 16A and 16D are substantially parallel to each other;

the curved directions 22C and 22B of the second and third front surface regions 16C and 16B are substantially parallel to each other;

the curved directions 22A and 22C of the first and second front surface regions 16A and 16C are substantially perpendicular to each other.

Also, the geometric center 28A of the first front surface region 16A is provided between the zenith 26A of the first front surface region 16A and the second front surface region 16C;

the geometric center 28C of the second front surface region 16C is provided between the zenith 26C of the second front surface region 16C and the fourth front surface region 16D;

the geometric center 28B of the third front surface region 16B is provided between the zenith 26B of the third front surface region 16B and the first front surface region 16A;

the geometric center 28D of the fourth front surface region 16D region is provided between the zenith 26D of the fourth front surface region 16D region and the third front surface region 16B.

Typically, the panel back surface 14 is substantially flat and each of the front surface regions 16A, 16B, 16C and 16D defines a zenith-to back surface distance, the zenith-to-back surface distances being selected from a discrete number of distances smaller than a number of the front surface regions 16A, 16B, 16C and 16D. For example, and non-exclusively, the discrete number is 2. However, in other examples, the discrete number is larger than 2. In yet another example, there is only one zenith-to-back surface distance for all the front surface regions 16A, 16B, 16C and 16D.

In some embodiments of the invention, the acoustic panel 10 is solid between the panel front and back surfaces 12 and 14. This creates a relatively large mass to reflect incoming sound waves. However, in alternative embodiments, there is an air gap between the panel front and back surfaces 12 and 14. In yet other embodiments, the acoustic panel 10 includes a shell defining the panel front and back surfaces 12 and 14 and the shell is filled with a different material, such as a foam.

In some embodiments, the acoustic panel 10 includes a plurality of acoustic elements 30 and 32. The acoustic panel 10 includes two types of acoustic elements 30 and 32, but it is within the scope of the invention to have only one type of acoustic elements 30 and 32 or more than two types of acoustic elements 30 and 32. Each of the acoustic elements 30 and 32 defines a respective one of the front surface regions 16A, 16B, 16C and 16D. The acoustic elements 30 and 32 are in a side-by-side relationship relative to each other, and typically abut against each other.

Also, in some embodiments, the acoustic panel 10 includes a frame 34 and a support element 36, for example a plate-shaped member. The frame 34 is mounted to the support element 36 in a conventional manner. The acoustic elements 30 and 32 are mounted to the support element 36 inside the frame 34, for example by being glued to the support element 36. However, in alternative embodiments of the invention, the acoustic elements 30 and 32 are mounted to the support element 36 in any other suitable manner. In yet other embodiments of the invention, there are no support element 36 or no frame 34, or both no support element 36 and no frame 34 and the acoustic elements 30 and 32 are simply secured to each other, for example using glue.

Figure 4:
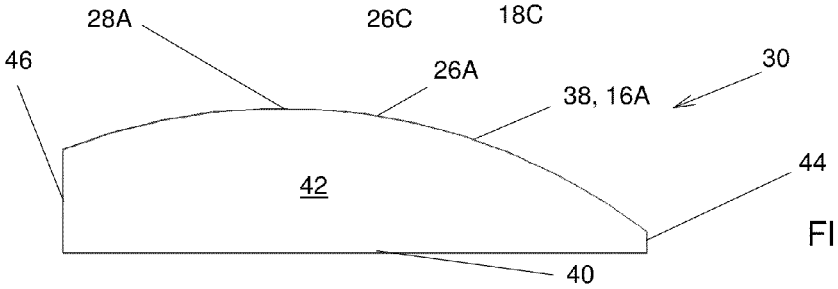
FIG. 4, in a side elevation view, illustrates an acoustic element part of the acoustic panel shown in FIGS. 1 to 3.

FIG. 4 illustrates an acoustic element 30 that defines the first front surface region 16A. Acoustic element 32 is similar thereto and the differences therewith are detailed hereinbelow. Each acoustic element 30 defines an acoustic element front surface 38, which defines one of the front surface regions 16A, 16B, 16C and 16D, an opposed acoustic element back surface and an acoustic element peripheral surface 42. The acoustic element 30 also defines an acoustic element first end 44 and an opposed acoustic element second end 46, the acoustic element first and second ends 44 and 46 being opposed to each other along one of the curved directions 22A, 22B, 22C and 22D.

In some embodiments of the invention, due to the offset of each zenith 26A, 26B, 26C and 26D relative to a respective geometric center 28A, 28B, 28C and 28D and to the arc segment-shaped configuration of the acoustic element front surface 38 along the curved direction 22A, 22B, 22C and 22D. The distance between the acoustic element front and back surfaces 38 and 40 differ at the acoustic element first and second ends 44 and 46.

In a specific embodiment of the invention, as in the embodiment illustrated in the drawings, the acoustic element 32 differs from the acoustic element 30 in that the distance between the acoustic element front and back surfaces 38 and 40 is larger in the acoustic element 32 than in the acoustic element 30. It has been found that in a non-limiting example, having the largest of the distance between the acoustic element front and back surfaces 38 and 40 at the acoustic element first and second ends 44 and 46 for the acoustic element 30 be substantially equal to the smallest of the distance between the acoustic element front and back surfaces 38 and 40 at the acoustic element first and second ends 44 and 46 for the acoustic element 32 gives advantageous acoustic and aesthetic properties to the acoustic panel 10. However, other relationships between the dimensions of the two types of acoustic elements 30 and 32 are within the scope of the invention.

In alternative embodiments of the invention, the acoustic elements 30 and 32 can have any other suitable alternative shape, which depends on the shape of the front surface regions 16A, 16B, 16C and 16D. Also, the acoustic elements 30 and 32 can be all identical or can differ from each other in other manners, such as in height, width, length and curvature, among other possibilities.

Typically, the panel front surface 12 is relatively hard. For example, in some embodiments of the invention, the panel front surface 12 is a wood surface and the acoustic elements 30 and 32 are made of wood. However, any other suitable material, such as a foam or a polymer is within the scope of the invention. Also, each acoustic element 30 and 32 can be moulded individually, or the whole acoustic panel 10 can be moulded integrally as a unit. In some embodiments of the invention, the panel front surface 12 may be defined by a thin or thick layer of foam supported by a harder material.

In some embodiments of the invention, the panel front surface 12 is configured to prevent multiple reflections on the acoustic panel 10 of the sound waves incoming on substantially all of the panel front surface 12. This is achieved by having a panel front surface 12 in which adjacent surfaces are angled at relatively open angles relative to each other and in which no deep recesses are created that could trap sound waves.

EXAMPLE

Figure 5:
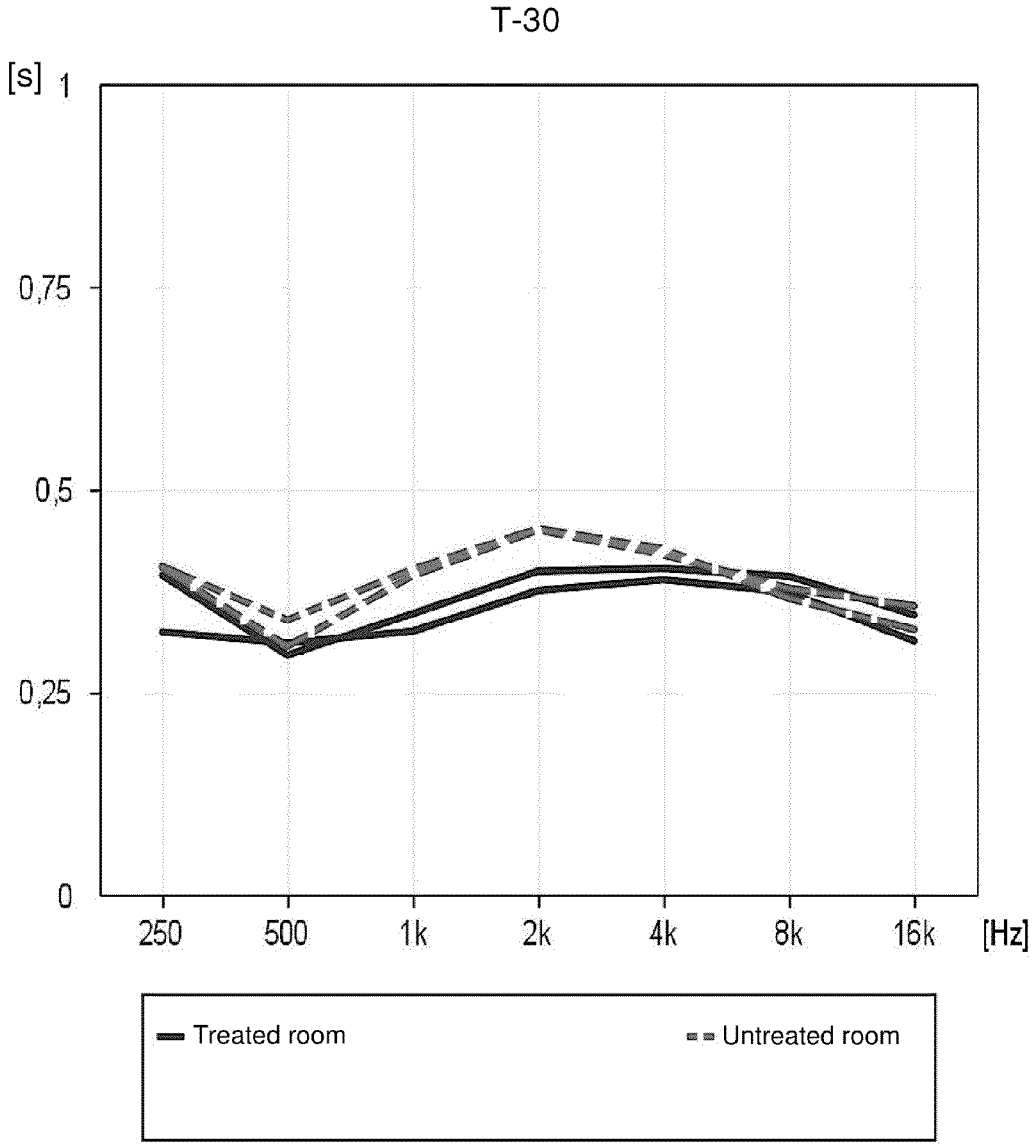
FIG. 5, in an X-Y graph, illustrates the effect of treatment of a room with acoustic panels 10 on the acoustic parameter T30 in the room.

An acoustic panel 10 was formed using 36 acoustic elements 30 and 32 having acoustic element front surfaces 38 in the shape of an arc segment of a cylindrical shell with a radius of curvature of about 90 mm. The acoustic elements 0 and 32 were grouped in 9 groups of 4 forming the above-described helicoidal pattern. The acoustic element back surface 40 was flat and square with sides of about 90 mm in length. The zenith was about ⅓ of the way between the acoustic element first and second ends 44 and 46. The distance between the acoustic element front and back surfaces 38 and 40 at the acoustic element first and second ends 44 and 46 was about respectively 3 and 16 mm for the acoustic elements 30 of the first type and 16 and 28 mm for the acoustic elements 32 of the second type. The acoustic panels 10 are therefore relatively thin in some embodiments, which is advantageous for wall mounting. An omnidirectional speaker broadcast sounds successively at many frequencies and a dummy head with microphones in the ears was used to acquire the sounds produced by the speaker at each frequency. FIG. 5 illustrates the acoustic parameter T30 (the time the signal needs to drop by 30 dB) in seconds as a function of frequency for a room including (treated) or not including (untreated) the acoustic panels 10 for both ears of the dummy. The reverberation time for frequencies between 1000 and 4000 Hz was reduced significantly by the acoustic panels 10.

Although the present invention has been described hereinabove by way of preferred embodiments thereof, it can be modified, without departing from the spirit and nature of the subject invention as defined in the appended claims.

What is claimed is:

1. An acoustic panel for diffusing sound waves, said acoustic panel comprising:

a panel front surface and a substantially opposed panel back surface;

said panel front surface defining a plurality of convex front surface regions each delimited by a respective front surface region perimeter, each of said front surface regions being curved, said front surface regions each defining a curved direction and a flat direction substantially perpendicular thereto, said front surface regions being curved along said curved direction and rectilinear along said flat direction, each of said front surface regions defining a zenith along said curved direction, each of said front surface regions defining a geometric center, said zenith being offset from said geometric center along said curved direction, said front surface regions being discontinuous from each other such that a transition between two adjacent ones of said front surface regions defines a discontinuity in said panel front surface;

said front surface regions being disposed in a grid and covering all of said panel front surface, adjacent ones of said front surface regions that have partially parallel and adjacent front surface region perimeters having differently oriented curved directions;

whereby said sound waves incoming at said panel front surface are diffused by said panel front surface.

2. An acoustic panel as defined in claim 1, wherein a projection of each of said front surface regions on said panel back surface is substantially rectangular.

3. An acoustic panel as defined in claim 2, wherein a projection of each of said front surface regions on said panel back surface is substantially square.

4. An acoustic panel as defined in claim 1, wherein said front surface regions define at least one group including first, second, third and fourth front surface regions selected from all of said front surface regions, said first, second, third and fourth front surface regions being such that said first and second front surface regions are adjacent to each other and have partially parallel and adjacent front surface region perimeters;

said third and fourth front surface regions are adjacent to each other and have partially parallel and adjacent front surface region perimeters;

said first and third front surface regions are adjacent to each other and have partially parallel and adjacent front surface region perimeters;

said second and fourth front surface regions are adjacent to each other and have partially parallel and adjacent front surface region perimeters;

said curved directions of said first and fourth front surface regions are substantially parallel to each other;

said curved directions of said second and third front surface regions are substantially parallel to each other; and said curved directions of said first and second front surface regions are substantially perpendicular to each other.

5. An acoustic panel as defined in claim 4, wherein said first, second, third and fourth front surface regions are such that said geometric center of said first front surface region is provided between said zenith of said first front surface region and said second front surface region;

said geometric center of said second front surface region is provided between said zenith of said second front surface region and said fourth front surface region;

said geometric center of said third front surface region is provided between said zenith of said third front surface region and said first front surface region; and said geometric center of said fourth front surface region is provided between said zenith of said fourth front surface region and said third front surface region.

6. An acoustic panel as defined in claim 1, wherein said back surface is substantially flat, each of said front surface regions defining a zenith-to back surface distance, said zenith-to-back surface distances being selected from a discrete number of distances smaller than a number of said front surface regions.

7. An acoustic panel as defined in claim 6, wherein said discrete number is 2.

8. An acoustic panel as defined in claim 1, wherein said front surface regions have a substantially arc segment-shaped configuration along said curved direction.

9. An acoustic panel as defined in claim 1, wherein said acoustic panel is solid between said panel front and back surfaces.

10. An acoustic panel as defined in claim 1, wherein said front surface regions are substantially adjacent to each other.

11. An acoustic panel as defined in claim 1, wherein said acoustic panel includes a plurality of acoustic elements, each of said acoustic elements defining a respective one of said front surface regions, said acoustic elements being in a side-by-side relationship relative to each other.

12. An acoustic panel as defined in claim 11, wherein said acoustic elements abut against each other.

13. An acoustic panel as defined in claim 1, wherein said panel front surface is a wood surface.

14. An acoustic panel as defined in claim 1, wherein said panel front surface is configured to prevent multiple reflections on said acoustic panel of said sound waves incoming on substantially all of said panel front surface.

* * * * *